US006033746A

United States Patent [19]

Morris

[11] Patent Number: 6,033,746

[45] Date of Patent: Mar. 7, 2000

[54] JIGSAW

[75] Inventor: Steven Morris, North Humberside, United Kingdom

[73] Assignee: Lights, Camera Interaction!, Inc., Norwalk, Conn.

[21] Appl. No.: 09/000,466

[22] PCT Filed: Aug. 2, 1996

[86] PCT No.: PCT/GB96/01881

§ 371 Date: Apr. 24, 1998

§ 102(e) Date: Apr. 24, 1998

[87] PCT Pub. No.: WO97/05933

PCT Pub. Date: Feb. 20, 1997

[30] Foreign Application Priority Data

Aug. 4, 1995 [GB] United Kingdom ..... 9516043

[51] Int. Cl.[7] ..... B32B 3/06

[52] U.S. Cl. ..... 428/33; 428/195; 273/157 R

[58] Field of Search ..... 428/33, 195, 192; 273/157 R

[56] References Cited

U.S. PATENT DOCUMENTS 4,177,305 12/1979 Feingold et al. ..... 273/157 R 5,330,806 7/1994 Bythewood et al. ..... 428/33

*Primary Examiner*—Alexander Thomas

*Attorney, Agent, or Firm*—Morrison Law Firm

[57] ABSTRACT

A jigsaw with at least some pieces being adapted to be placed alongside a plurality of other pieces by having an upper surface feature extending substantially completely along any one or more of the mating edges so that any other piece with a corresponding upper surface feature extending substantially completely along any one of the corresponding mating edges can be placed along side the or any one of the corresponding upper surface feature edges of the former piece. Preferably, the upper surface features extend completely along a whole number of mating edges and further surface features are provided along further mating edges of at least some of the pieces. Thereafter the surface feature remote from the mating edge may form a common border with one or more other surface feature remote borders. The invention allows the interchange of pieces to create new surface features.

5 Claims, 2 Drawing Sheets

JIGSAW

Figure 1:
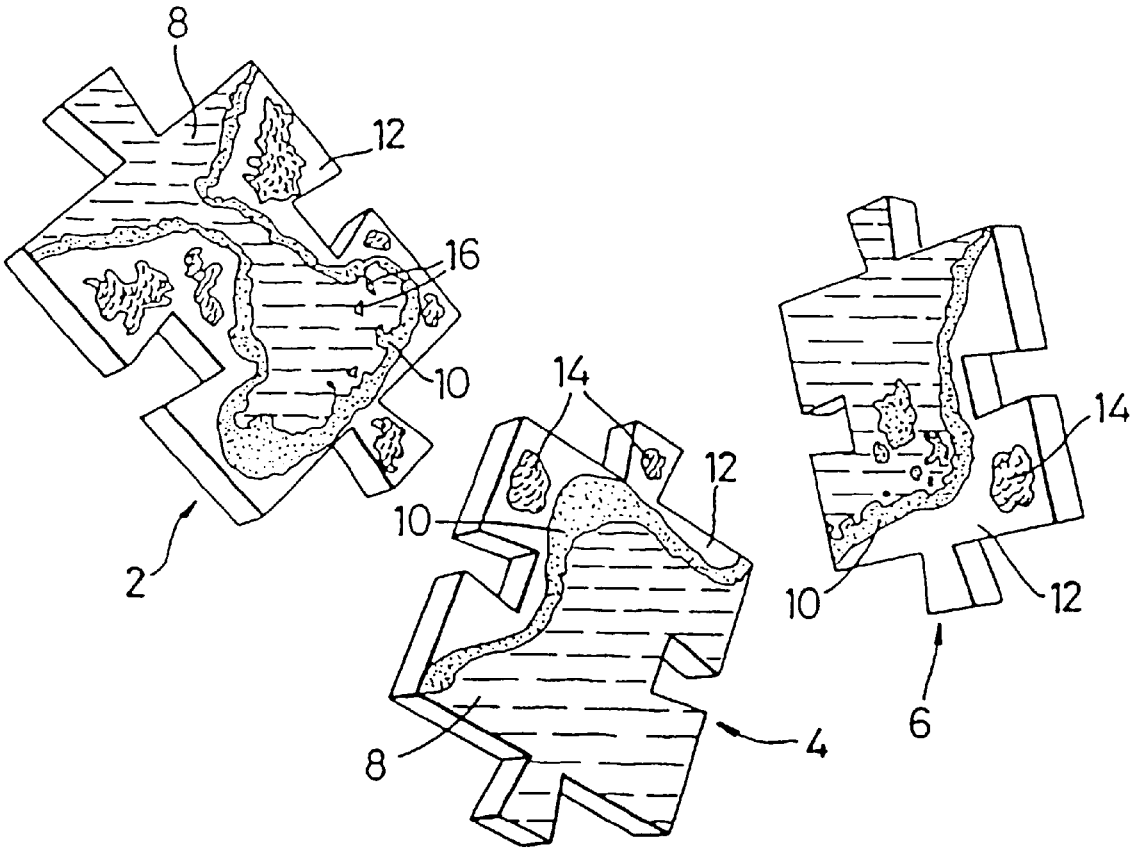

The present invention relates to a jigsaw and more particularly, a jigsaw with interchangeable pieces.

Providing more than one solution to a jigsaw puzzle has been disclosed in the prior art. Australian patent specification number 133511 discloses a jigsaw which is designed so that a panel of the puzzle bearing a representation can be interchanged with an auxilliary panel bearing a different representation so as to produce a variation of the original picture. The problem is solved by having common features along the puzzle interlocking edges of the respective panels and different features within the respective panels. Despite the fact that the panels are interchangeable, each of the pieces within each panel are designed to occupy a fixed position with respect to the other pieces in order to form the representation and individual pieces are not interchangeable.

Dutch patent application number 9100179 discloses two puzzles which are linkable by having matching edge sections. It appears that the puzzles can be linked together by having a common intersecting line. The line has to extend from top to bottom and the edge pieces are not in themselves interchangeable.

UK patent number 424772 overcomes the problem by providing a set of common pieces, such as parts of the anatomy, which can then be interchanged with other pieces presenting that same part of the anatomy in a different manner. Although this game provides some creativity, it does lack versatility and relies upon a pre-determined general solution so that the respective parts of the anatomy are always placed in the same relationship with the other parts even though any particular part has a varied set of pieces.

U.S. Pat. No. 4,052,074 relates to a similar concept but, in this case, relies upon the symmetrical morphology of its objects such as butterflies. The puzzle is limited to representations of forms which have inbuilt morphological dividing lines which form the edges of the pieces. Again, the main drawback is that each piece has a fixed location with respect to the other pieces in the puzzle even though by providing a variety of pieces for each position patterns and colours for each piece can be varied.

It is an object of the present invention to provide a jigsaw puzzle with greater versatility and more creative options.

According to the present invention there is provided a jigsaw comprising at least some pieces which are adapted to be placed alongside a plurality of other pieces by having an upper surface feature extending substantially completely along any one or more of the mating edges thereof so that any other piece with the corresponding upper surface feature extending substantially completely along any one of the corresponding mating edges thereof can be placed alongside the or any one of the corresponding upper surface feature edge(s) of the former piece.

By allowing any particular surface feature to extend, completely along one or more mating edges of the piece it can be matched up with the edge of another piece which similarly has the same surface feature extending completely along it. For instance, the surface feature may represent water such as a lake, ocean, river or sea. The piece may then be laid alongside any other piece which has the same water feature extending along one of the sides thereof. Because there is no break in the feature along the edge it may be mated with any other piece in the jigsaw which has the same feature extending completely along one of its edges.

Preferably, the upper surface feature extends completely along a whole number of mating edges. Thus, in a piece with four edges the upper surface feature may extend along one, two, three or four of the edges of the piece. In this way, if the surface feature extended along two edges, say at right angles, it would not impinge upon the third or fourth edge which would leave these latter edges free to accomodate a different feature which could then be combined with any other piece with such a different feature. Thus the versatility of the game is considerably increased by only having the upper surface feature extending completely along a whole number of mating edges and thus minimising mismatching between pieces.

Typically, there will be more than one surface feature on a piece and in a piece with four edges up to four different surface features could be provided. The surface feature may include a border which will meet the periphery of the piece at the junctures or corners between the edges and this will also seperate different surface features. It will be appreciated that in such cases the surface feature border may not match as well with other pieces having the same surface feature without a border and for this reason the border thickness is kept relatively narrow at the corners of the piece in order to minimise incongruity. The borders between these different surface features will always extend from the corners of the piece between two edges. However, subject to this limit, the borders may thereafter be contoured to present any desired effect between the surface features and it is envisaged that the border itself may form a further surface feature within the piece. As the border of the piece, typically, terminates at the corner between two edges it may be matched up with the border of a mating piece to present a newly created border for the surface feature. In this manner, a whole array of patterns, landscapes etc can be produced by the creativity of the user of the puzzle.

Although it is possible for the shapes of the pieces of the jigsaw to be irregular, it is preferred that most, if not all, of the pieces will be of the same shape and size so as to provide an almost unlimited number of solutions to the puzzle. Nevertheless, it is possible to incorporate some fixed solutions into the puzzle and this is particularly the case where it is necessary to incorporate a continuous feature such as a road or railway track across the puzzle.

It is also envisaged that the puzzle can incorporate three-dimensional features into the upper surface feature which may add to the appeal of the puzzle.

Although, strictly, jigsaws generally consist of irregularly shaped interlocking pieces, it is also envisaged that embodiments having identically shaped non-interlocking pieces can also be provided. In such puzzles, the pieces may simply be laid side by side without the necessity to provide any interlocking means. Alternatively, the pieces could be interlocked by other means which do not affect the shape of the upper surface.

Figure 2:
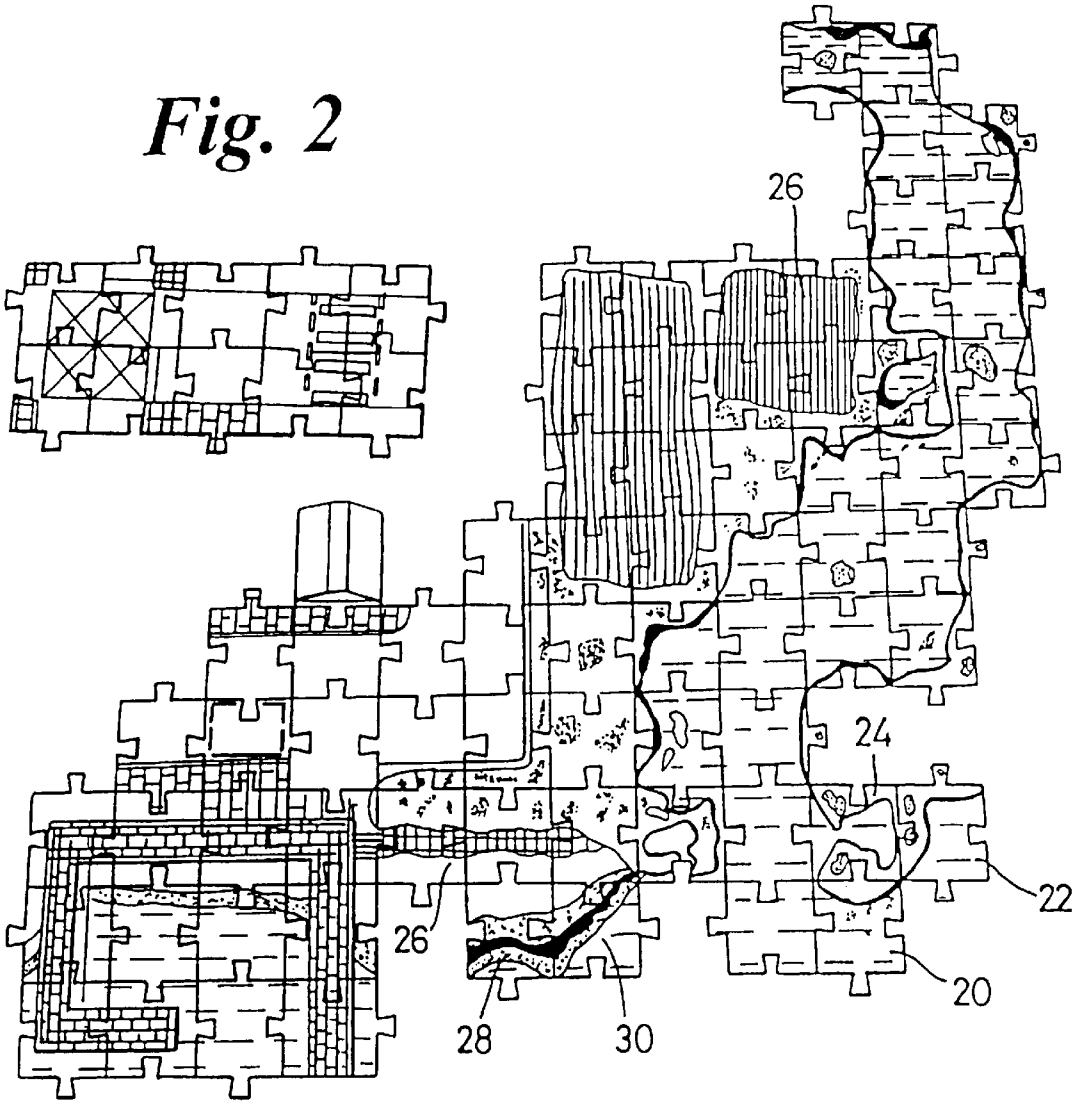

An embodiment of the invention will now be described, by way of example, with reference to the accompanying drawings in which:

FIG. 1 shows an array of pieces in accordance with the present invention; and FIG. 2 shows a partially completed jigsaw having pieces in accordance with the present invention.

Referring to FIG. 1, three pieces, 2, 4, 6, in particular, are shown. Each piece reveals three types of upper surface feature which represent sea, rocks and land respectively and which are coloured blue, brown and green respectively in the actual embodiment. Referring to piece 2, the upper surface feature of the sea 8 can be seen to extend completely along one of the mating edges of the piece but does not impinge upon any of the other three mating edges. The sea feature is surrounded by a border which takes the form of rocks 10 and extends from the corner of the edge upon which the sea feature impinges to the other corner of the said edge by way of a meandering path which does not impinge upon any of the other edges. The border is surrounded on its other side by land features 12 which cover exactly three sides of the piece and extend into the piece interior to meet the border. Referring to piece 4, the sea feature 8 can be seen to extend completely along two of the side edges of the four sided piece with the border rock area 10 extending in a meandering fashion from one corner of the piece to the corner which is diagonally opposite. The rock feature does not impinge. upon the remainder of the piece, including the remaining two sides, which is covered by the land feature 12. A similar arrangement but with a differently shaped border is found in piece 6. All three pieces have further surface features, such as bushes 14 and rock islands 16, which add to the variety of the landscapes possible.

Referring to FIG. 2, the partially assembled puzzle reveals a number of pieces in accordance with the present invention. For instance, piece 20 shows a land feature with a border extending along one side thereof but with water extending along the three other sides thereof. Piece 22 has the land feature extending across two sides with the water feature extending across the two remaining sides. Piece 24 has a land feature extending across three sides and a water feature extending across one side thereof. The three pieces are shown joined together by way of matching edges and it can be clearly seen that a new and creative landscape results therefrom. This would not be possible if each feature did not extend completely along one or more edges. As the puzzle of the invention can be mixed with traditional jigsaw pieces, a convenient example of the prior art type of piece is shown by feature 26 which is made up of four pieces which have a surface feature which does not extend completely along two of the side thereof respectively. Thus, of necessity, four pieces must be joined together and cannot sensibly be located separately. Nevertheless, even with this example, two of the edges are completely covered by a single surface feature and these are therefore able to interact with other pieces of the game so long as other pieces have a matching feature along one of their edges which, in this case, is land feature 12. Similarly, pieces 26, 28 and 30 have surface features extending completely along two of the edges thereof which are disposed on either side of the piece but have mixed surface features extending along the other two sides of the piece. Thus, the three pieces are designed to be aligned with each other along the mixed feature sides but to interact with the rest of the pieces of the game in a creative manner along the sides which present a single upper surface feature.

The game may give many solutions and can be mixed with fixed solution elements so as to provide a highly entertaining, creative and variable puzzle. The upper surface features described have included rocks, sea and land but it should be appreciated that many features can be incorporated into the pieces so long as the principle of extending completely along one or more sides is adopted.

We claim:

1. A jigsaw comprising:

a plurality of pieces;

said pieces having at least one of at least one protuberance and at least one indentation on a periphery thereof, such that said protuberance of a first piece mates with said indentation of a second piece;

said periphery of each piece having at least two mating edges which meet to provide at least two corners;

each of said pieces displaying at least two different upper surface features;

each of said pieces having a boundary between said upper surface features which extends from a first corner to a second corner of said piece;

each of said pieces having one of its upper surface features extending substantially completely along an edge so that pieces having the same surface feature extending completely along an edge can be placed alongside one another;

each piece having a plurality of other pieces of the same kind having boundaries which extend between corresponding corners; and said at least one of at least one protuberance or indentation of each kind of piece having at least one other piece which can be mated therewith to provide a continuous boundary which is different depending upon which of said at least one other piece is selected.

2. A jigsaw according to claim 1, in which the corners are adjacent to one another.

3. A jigsaw according to claim 1, in which at least some pieces have upper surface features extending substantially completely along all their mating edges.

4. A jigsaw according to claim 1, in which one or more corners are substantially rectangular.

5. A jigsaw according to claim 1, in which each piece or each kind of piece are identically shaped.

* * * * *